US005083947A

United States Patent [19]

Dominique et al.

[11] Patent Number: 5,083,947

[45] Date of Patent: Jan. 28, 1992

[54] ELECTRICAL CONDUCTOR TRAP TERMINAL AND CONNECTOR

[75] Inventors: Bertho Dominique; Matthew Wilhite, both of Limerick, Ireland

[73] Assignee: Molex Incoporated, Lisle, Ill.

[21] Appl. No.: 644,152

[22] Filed: Jan. 22, 1991

[51] Int. Cl.[5] ..... H01R 4/28

[52] U.S. Cl. ..... 439/725; 439/268

[58] Field of Search ..... 439/268, 417, 436, 441, 439/492, 493, 499, 656, 725, 729, 819, 822, 835, 836, 863, 857

[56] References Cited

U.S. PATENT DOCUMENTS

| | | | |
|---|---|---|---|
| 1,831,981 | 11/1931 | Ude | 439/834 |
| 2,036,461 | 4/1936 | Darby | 439/822 X |
| 3,538,486 | 11/1970 | Shlesinger, Jr. | 439/656 X |
| 4,713,020 | 12/1987 | Awano et al. | 439/268 X |
| 4,759,726 | 7/1988 | Naylor et al. | 439/441 |
| 4,978,315 | 12/1990 | Edglay et al. | 439/499 X |
| 4,981,432 | 1/1991 | Kikuchi | 439/499 X |

FOREIGN PATENT DOCUMENTS 3303178 8/1984 Fed. Rep. of Germany ..... 439/729

*Primary Examiner*—Neil Abrams
*Assistant Examiner*—Khiem Nguyen
*Attorney, Agent, or Firm*—Louis A. Hecht; Stephen Z. Weiss; A. A. Tirva

[57] ABSTRACT

An electrical wire trap-type terminal includes a pair of terminal arms projecting from a base. The terminal arms are spring loaded whereby, when the terminal arms are moved to a conductor receiving position, the terminal arms will return automatically to a conductor trapping position. The terminal arms define a jaw configured such that relative movement of the terminal arms to the conductor receiving position opens the jaw to receive the conductor, the jaw trapping the conductor when the terminal arms are released and in their conductor trapping position. A housing is provided in conjunction with the terminal and through which the conductor is inserted into the jaw. The housing is effective to open the jaw to the conductor receiving position.

13 Claims, 3 Drawing Sheets

ELECTRICAL CONDUCTOR TRAP TERMINAL AND CONNECTOR

FIELD OF THE INVENTION

This invention is directed to the art of electrical connectors and, particularly, to an electrical conductor trap-type terminal and connector.

BACKGROUND OF THE INVENTION

A wide variety of electrical connectors are known in which an electrical conductor, such as an electrical wire having a stripped distal end to expose the conductor, is terminated in a terminal which clamps the conductor. In some such terminals, portions of the terminals are crimped to clamp the conductor. In other terminals, commonly called wire trap terminals or connectors, the wire is inserted into the terminal or connector and is physically grasped by movable portions of the terminal. This invention is directed to such wire trap-type terminals.

One of the problems in using wire trap terminals and/or connectors is in applications employing stranded wires. Often, the stranded conductors lose their integrity or reliability because of the normal tendency of the strands to spread out. In fact, some wire trap terminals themselves have a tendency to spread the strands and destroy good contact force retention. This is particularly true where the terminals are forced, as by a housing, toward their clamping conditions. Although the present invention is quite useful for use with solid conductor wires, it is particularly applicable for use with stranded wires because of its tendency to "gather" the conductor strands as described hereinafter.

SUMMARY OF THE INVENTION

An object, therefore, of the invention is to provide a new and improved electrical conductor trap-type terminal and connector.

The invention is disclosed in various embodiments. Generally, the invention contemplates a terminal which includes a base and a pair of terminal arms projecting from the base. The terminal arms are self-spring loaded whereby, when the terminal arms are moved relative to each other to a conductor receiving position, the terminal arms will return automatically to a conductor trapping position. The terminal arms include jaw means configured such that relative movement of the terminal arms to the conductor receiving position opens the jaw means to receive the conductor. The jaw means trap the conductor when the terminal arms are released and in the conductor trapping position.

In one embodiment of the invention, the terminal arms are spring biased toward each other when moved away from each other and include jaw means for trapping an electrical conductor therebetween. The terminal arms can be spread, as by a housing component, against their spring bias to open the jaw means and receive the conductor, with the jaw means trapping the conductor when the terminal arms are released.

As disclosed herein, the jaw means are configured to form an opening for receiving the conductor, the opening having an axis coincident with the conductor when positioned in the opening. and the opening being of a diamond shape to gather strands of a stranded conductor toward the axis of the opening when the jaw means close onto the conductor.

More particularly, the jaw means comprise tabs on each terminal arm projecting toward the other terminal arm and spaced from the axis of the opening. The tabs are arranged with a pair of tabs disposed on each terminal arm, the tabs of each pair being offset to opposite sides of the axis, and the tabs on each terminal arm being axially spaced to receive a tab from the opposite terminal arm therebetween.

The invention also contemplates a housing adapted for use with the above-described terminal, with the housing and the terminal arms having complementary interengaging means for spreading the terminal arms in response to relative movement between the housing and the terminals. Specifically, the housing is assembled to the terminal in a first position which interacts with the terminal arms to spread the arms and open the conductor-receiving opening therebetween. The conductor is inserted into the opening, and movement of the housing to a second, fully assembled position allows the spring biased terminal arms to close toward each other and trap the conductor in the jaw means.

In another, second embodiment of the invention, the terminal arms are spring biased away from each other when moved toward each other and, again, jaw means are provided for trapping an electrical conductor therebetween. The jaw means are configured such that movement of the terminal arms toward each other, as by a housing component, against their spring bias, opens the jaw means to receive the conductor. The jaw means trap the conductor in response to the spring bias when the terminal arms are released.

In the second embodiment of the invention, two forms of jaw means are disclosed. In one form, a pair of tabs are disposed on one terminal arm, and a single tab is disposed on the other terminal arm. The tabs of the pair are offset on one side of the aforesaid axis, and the single tab is disposed on the opposite side of the axis. In a second form of the second embodiment, each terminal arm has a single tab, the tabs being disposed offset on opposite sides of the axis.

A feature of the invention is the provision of retention arms projecting from the base of the terminal for maintaining the terminal in its housing. The retention arms are in the form of cantilevered, spring-type members having latching hooks on the distal ends thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 6:
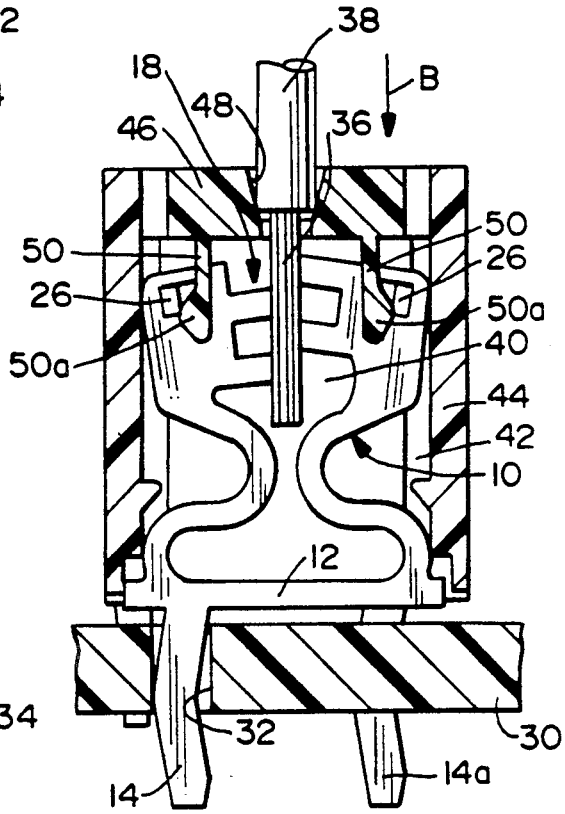
FIG. 6 is a sequential view similar to that of FIG. 5, with the housing moved toward the printed circuit board and spreading the terminal arms, and showing an electrical conductor inserted into the housing between the spread terminal arms.
Figure 7:
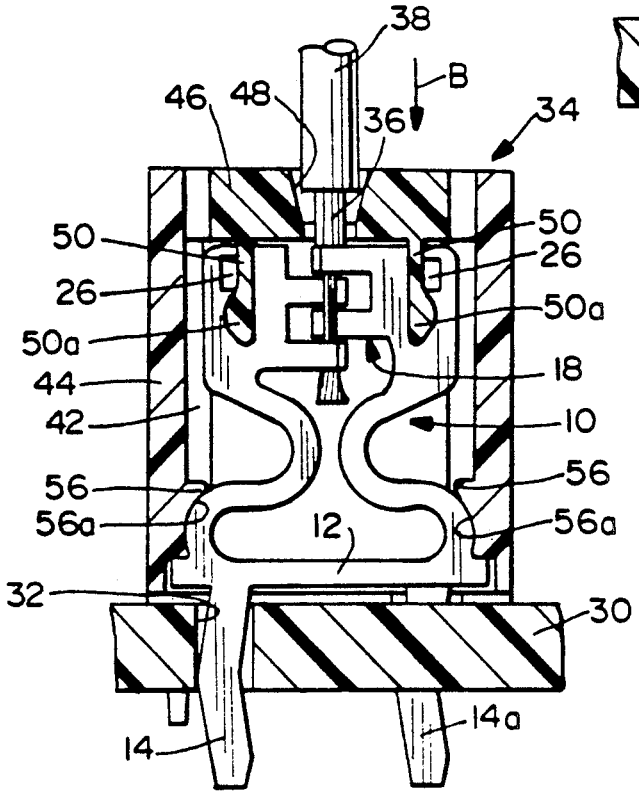
FIG. 7 is a sequential view similar to that of FIGS. 5 and 6, with the housing fully assembled to the terminal and the terminal arms released for closing onto and trapping the electrical conductor.
Figure 8:
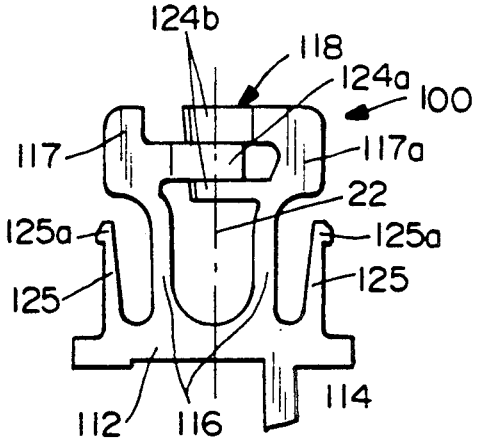
FIG. 8 is an elevational view of a first form of a second embodiment of the conductor trap terminal of the invention in its normal unbiased state, with the terminal arms in closed position.

The invention is disclosed herein in two different embodiments, namely a first embodiment illustrated in FIGS. 1-7 and a second embodiment illustrated in FIGS. 8-13. Furthermore, the second embodiment of FIGS. 8-13 are shown in two different forms, one of which is shown in FIG. 8, and a second of which is shown in FIGS. 9-13.

Figure 4:
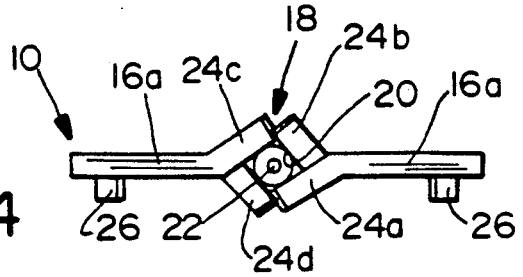
FIG. 4 is a top plan view of the terminal in the position of FIG. 3.
Figure 2:
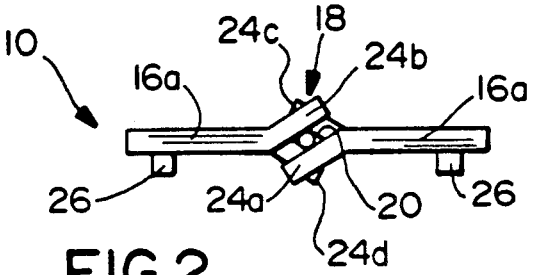
FIG. 2 is a top plan view of the terminal in the position of FIG. 1.
Figure 3:
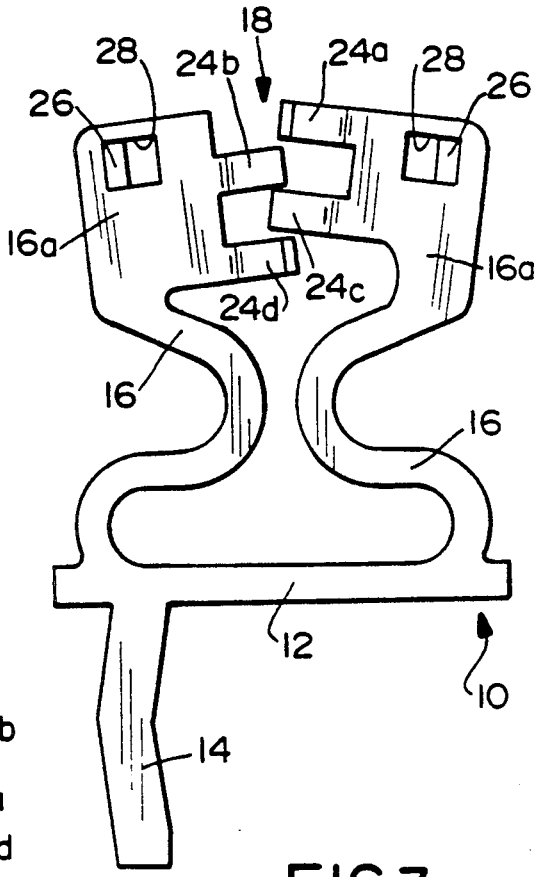
FIG. 3 is an elevational view similar to that of FIG. 1, with the terminal arms spread apart to receive an electrical conductor.
Figure 1:
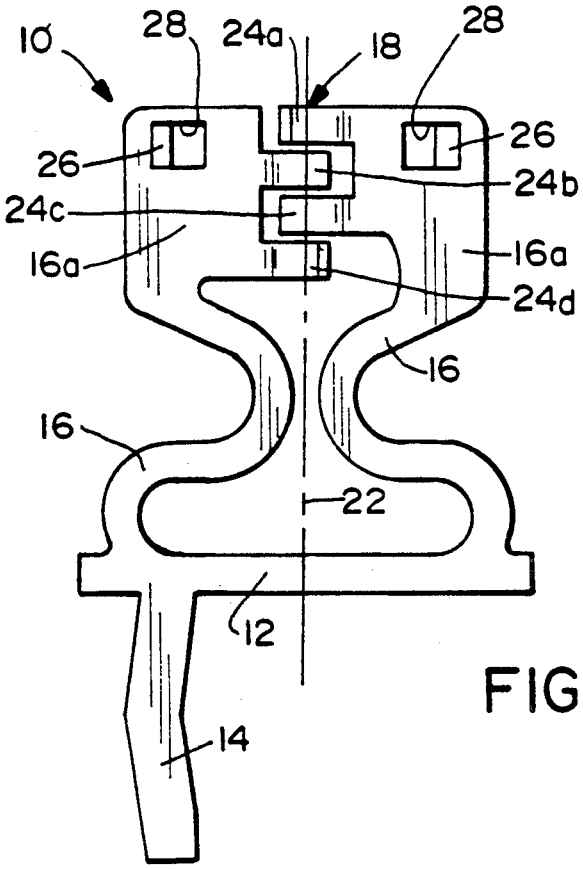
FIG. 1 is an elevational view of one embodiment of the conductor trap terminal of the invention in its normal unbiased state, with the terminal arms in closed position.

Referring to the drawings in greater detail, and first to FIGS. 1-4, a terminal, generally designated 10, is shown for receiving and trapping a conductor such as an electrical wire or a mating terminal pin. The terminal is adapted for mounting on a printed circuit board and for disposition within a housing as described below in relation to FIGS. 5-7. Generally, terminal 10 is shown in FIGS. 1 and 2 in a "natural" or unbiased state defining a closed position of its terminal arms, and FIGS. 3 and 4 show the terminal in an open condition with its terminal arms spread apart for receiving an electrical wire.

Figure 5:
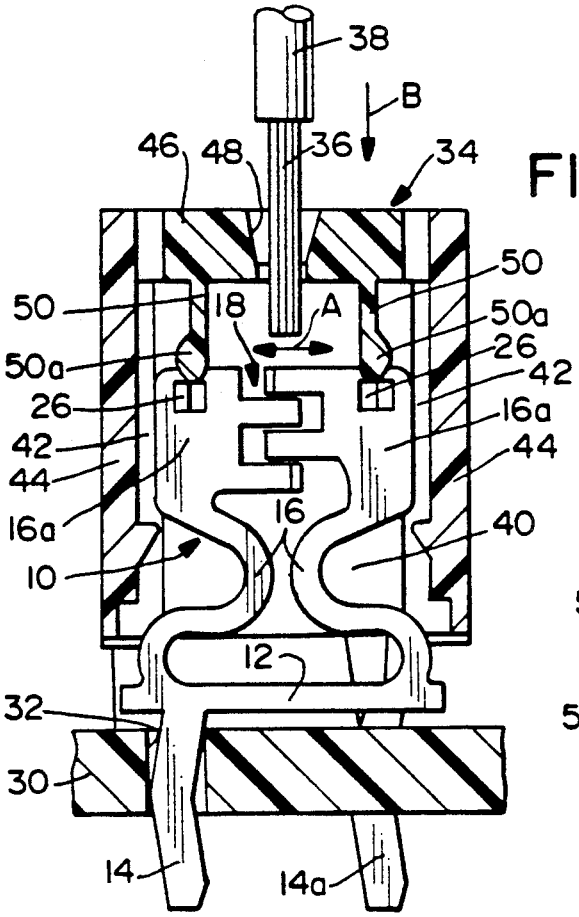
FIG. 5 is an elevational view of the terminal as shown in FIG. 1, mounted on a printed circuit board, with a housing in a preliminary position about to be assembled to the terminal, the housing being shown in section.

More particularly, terminal 10 includes a generally flat base or buss bar 12 having a solder tail 14 projecting downwardly therefrom for insertion through a hole in a printed circuit board (see FIGS. 5-7). A pair of terminal arms 16 project upwardly from base 12 and are inwardly bowed, as shown, whereby the arms are self-spring-loaded when moved away from their natural or free state shown in FIGS. 1 and 2. The terminal arms thereby form spring arms of the terminal. Terminal 10 is a unitary structure stamped and formed of metal material including base 12, solder tail 14 and spring arms 16.

Spring arms 16 terminate in enlarged portions 16*a* defining jaw means, generally designated 18, for trapping an electrical conductor or wire therebetween. The spring arms can be spread apart against their spring bias to positions shown in FIGS. 3 and 4 wherein jaw means 18 are opened for easily receiving the electrical wire therebetween. As described in greater detail hereinafter, when the spring arms are released, the jaw means close onto the wire, back to the position shown in FIGS. 1 and 2, trapping and terminating the wire.

Jaw means 18 are configured to define a wire-receiving opening 20 (FIGS. 2 and 4) having an axis 22 (FIGS. 1 and 3) coincident with the wire when positioned in the opening. As can be seen in FIGS. 2 and 4, the jaw means are configured to form the opening in a diamond shape. Although the terminal and the connector, described hereinafter, are quite useful for use with solid wire applications, the diamond shaped opening is particularly applicable for use with electrical wires having stranded conductors which have a natural tendency to spread. The diamond shaped opening, when closed onto the stranded conductor, gathers the conductor toward axis 22 to maintain the integrity and reliability of the conductor.

In order to form jaw means 18 as described above, resulting in the diamond shaped opening 20, the jaw means are formed by tabs 24*a*, 24*b*, 24*c* and 24*d*, the tabs on each spring arm projecting toward the other spring arm and spaced from axis 22. Generally, each terminal arm has a pair of the tabs, the tabs of each pair being offset to opposite sides of axis 22, and the tabs on each terminal arm being axially spaced to receive a tab from the opposite terminal arm. In this manner, a completely closed opening 20 is formed for receiving the electrical wire.

Specifically, tabs 24*a* and 24*c* project inwardly from the right-hand terminal arm as shown in FIGS. 1-4, and tabs 24*b* and 24*d* project inwardly from the left-hand terminal arm. Looking downwardly onto the top of the terminal as shown in FIGS. 2 and 4, it can be seen that tab 24*a* of the right-hand terminal arm is bent or offset to one side of axis 22, and the top tab 24*b* of the left-hand terminal arm is bent to the side of axis 22 opposite tab 24*a*. Continuing downwardly, bottom tab 24*c* of the right-hand terminal arm is bent to the same side of axis 22 as is top tab 24*b* of the left-hand terminal arm. Continuing, bottom tab 24*d* of the left-hand terminal arm is bent to the same side of axis 22 as the top tab 24*a* of the right-hand terminal arm. Therefore, a discreet opening is defined by the four alternatingly bent tabs to provide lateral stability for the conductor when positioned axially between the tabs from the top of the jaw means to the bottom thereof.

Lastly, in relation to FIGS. 1-4, bosses 26 are stamped and formed out of openings 28 (FIGS. 1 and 3) so as to project laterally to one side of the terminal arms for engagement by a housing component (described hereinafter) to facilitate opening and closing the terminal arms.

FIGS. 5-7 show sequential views of terminal 10 mounted to a printed circuit board 30 with solder tail 14 projecting through a hole 32 in the printed circuit board for soldering or otherwise connecting to circuit traces on the board. Of course, this is but one use of the novel wire trap terminal of the invention. Another use might be to trap a terminal pin instead of a wire.

FIGS. 5-7 also show a housing, generally designated 34, for assembly about terminal 10 and for effecting opening and closing of the terminal arms to receive and trap a conductor 36 of an electrical wire 38, in response to movement of the housing to its assembled position relative to the terminal, as depicted by the sequence of positions illustrated in FIGS. 5-7. Housing 34 may be in the form of a header which is elongated in a direction perpendicular to the drawings to define an elongated cavity 40 within which a plurality of terminals 10 are housed in a row. The housing has a series of grooves 42 on the interior thereof for positioning the terminals in spaced relationship longitudinally along and transversely across elongated cavity 40. For instance, a solder tail 14*a* is shown and represents the solder tail of a terminal immediately behind the terminal shown in full lines in the drawings.

Housing 34 has side walls 44 and a top wall 46 defining cavity 40. The top wall has a series of tapered holes 48 each being provided for insertion therethrough of electrical wire 38 and conductor 36.

In order to spread terminal arms 16 to open jaw means 18 and allow insertion of conductor 36 therein, in response to assembly of housing 34 onto terminals 10, a pair of actuator arms 50 are provided depending from the underside of top wall 46 of the housing, one for each terminal. The actuator arms have enlarged cam portions 50*a* for engaging bosses 26 on the terminal arms. It can be seen that the actuator arms are disposed inside of the bosses so that the terminal arms are spread outwardly away from each other in the direction of arrows "A" in FIG. 5. As will be seen below, the enlarged cam portions 50*a* and the outside surfaces of actuator arms 50 define a cam profile for spreading the terminal arms and then allowing the terminal arms to move back toward each other and trap conductor 36 therebetween, in response to assembly of the housing onto the terminals in the direction of arrows "B".

More particularly, in operation, FIG. 5 shows housing 34 assembled onto the top of the row of terminals 10 in elongated cavity 40 in a pre-assembly or preinsertion position. It can be seen that enlarged cam portions 50*a* of actuator arms 50 have engaged bosses 26 on the terminal arms but have not spread the arms to any extent. FIG. 6 shows housing 34 moved downwardly in the direction of arrow "B" to a position wherein enlarged cam portions 50*a* of actuator arms 50 have spread terminal arms 16 to their maximum deflection by means of engagement of enlarged cam portions 50*a* with bosses 26. This position of the terminal arms and jaw means 18 corresponds to that shown in FIGS. 3 and 4. In this spread position of the terminal arms, electrical wire 38 can be pushed into hole 48 in the top wall of the housing, with conductor 36 being moved downwardly between the tabs of the jaw means which define opening 20 (FIGS. 3 and 4) for receiving the conductor. By properly designing the taper of hole 48 in the top wall of the housing in relation to the diameter of electrical wire 38, the hole itself can define a stop means for maximum insertion of the wire whereby the conductor is properly positioned in the jaw means.

FIG. 7 shows housing 34 moved downwardly to its completely assembled position whereat enlarged cam portions 50*a* of actuator arms 50 now have passed bosses 26 on the terminal arms. The terminal arms therefore move under their self-spring-bias inwardly toward each other to trap conductor 36 between the tabs which define jaw means 18. It should be noted that bosses 26 on the terminal arms are in engagement with the outside edges of actuator arms 50. This provides means for preventing the terminal from rocking in a side-to-side direction, transverse to axis 22. It also can be seen in FIG. 7 that housing 34 has seated onto the surface of printed circuit board 30.

Lastly, means are provided on the inside of housing 34 for positively retaining the terminal therewithin in a stable condition. Specifically, interior retention ribs 56 are provided with inner curve surfaces 56*a* mating with the curvature of terminal arms 16 at that location whereby the terminal is rigidly fixed in a positional relationship relative to the housing.

Figure 9:
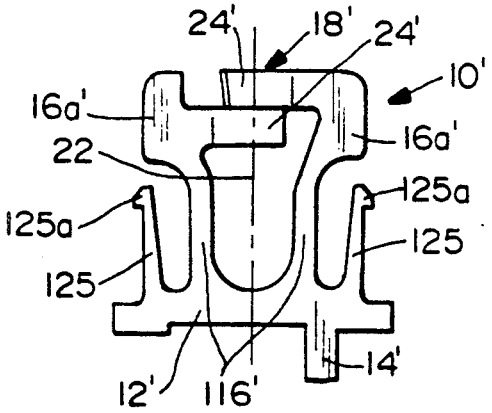
FIG. 9 is an elevational view of a second form of the second embodiment of the conductor trap terminal in its unbiased state, again with the terminal arms in closed position.

A second embodiment of the invention is shown in FIGS. 8-13. This embodiment is illustrated in two different forms as shown in FIGS. 8 and 9.

More particularly, referring first to FIG. 8, a terminal, generally designated 100, includes a generally flat base or buss bar 112 having a solder tail 114 projecting downwardly therefrom and a pair of terminal arms 116 projecting upwardly therefrom similar to the embodiment of the invention shown in FIGS. 1-7. Terminal arms 116 have opposing enlarged portions 117 and 117*a* defining jaw means, generally designated 118. Enlarged portion 117 has a single tab 124*a*, and enlarged portion 117*a* has a pair of tabs 124*b*. The tabs on each terminal arm project toward the other terminal arm and are spaced transversely of axis 22. Tab 124*a* is offset to one side of the axis, and tabs 124*b* are offset to the opposite side of the axis. Terminal 100 includes retention arms 125 projecting upwardly from base 112, for purposes described hereinafter Referring next to FIGS. 9-13, a second form of the second embodiment of the invention is illustrated and primed numerals have been applied corresponding to the numerals of the embodiment of the invention shown in FIGS. 1-7. More particularly, a terminal, generally designated 10' again includes a generally flat base or buss bar 12' having a solder tail 14' projecting downwardly therefrom for insertion through a hole in a printed circuit board (see FIGS. 10 and 11). A pair of terminal arms 16' project upwardly from base 12 and are self-spring-loaded when moved away from their natural or free state shown in FIG. 9. The terminal arms thereby form spring arms of the terminal.

Spring arms 16' terminate in enlarged portions 16*a'* defining jaw means, generally designated 18' for trapping an electrical conductor or wire therebetween. In this embodiment of the invention (in both forms shown in FIGS. 8 and 9) the spring arms can be moved toward each other against their spring bias to positions shown in FIGS. 10 and 11 (described hereinafter) wherein jaw means 18' are opened for easily receiving the electrical wire therebetween. As described in greater detail hereinafter, when the spring arms are released, the jaw means close onto the wire, back to the position shown in FIG. 9 (and FIGS. 12 and 13), trapping and terminating the wire.

Jaw means 18' are configured to define a wirereceiving opening 20' (FIG. 11) defining axis 22 (FIG. 9) coincident with the wire when positioned in the opening. As seen in FIG. 11, the opening again is in a diamond configuration or shape.

Jaw means 18' are formed by tabs 24', a tab on each spring arm projecting toward the other spring arm and spaced from axis 22. Generally, the tab of each spring arm is offset to a side of axis 22 opposite the tab of the other spring arm, the tabs being axially spaced relative to axis 22.

Like the first form of the second embodiment of the invention shown in FIG. 8, the form shown in FIG. 9 includes retention arms 125 for purposes described hereinafter.

Figure 10:
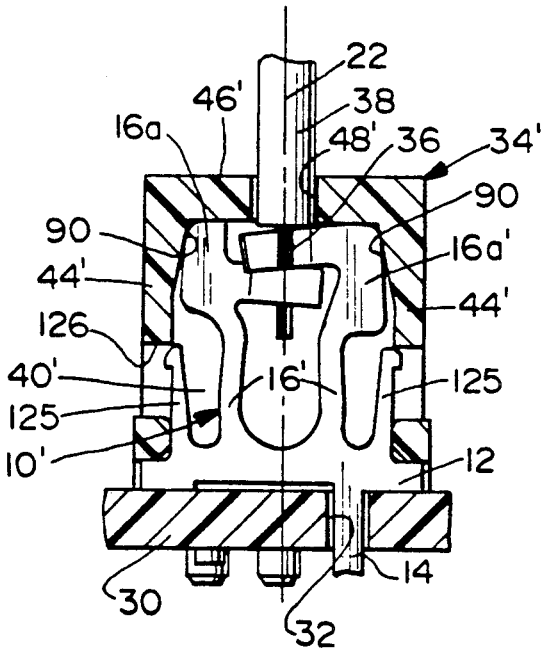
FIG. 10 is an elevational view of the terminal shown in FIG. 9, with the terminal arms moved toward each other by a housing to open the jaw means for receiving a conductor, the housing being shown in section.
Figure 12:
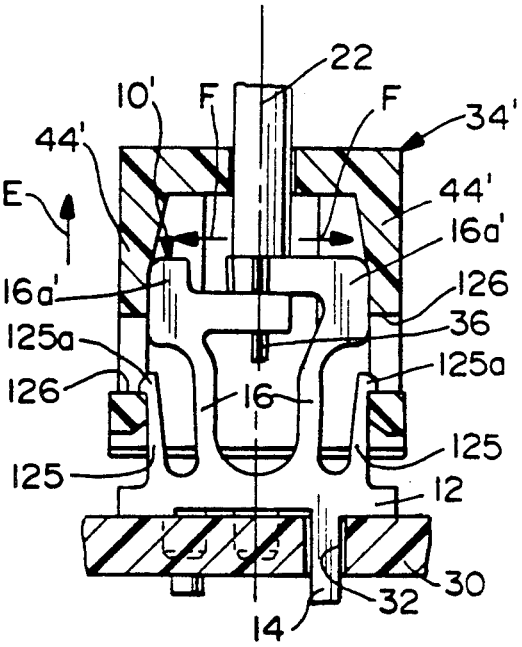
FIG. 12 is a view similar to that of FIG. 10, with the housing moved to a position for releasing the terminal arms for trapping the conductor.
Figure 11:
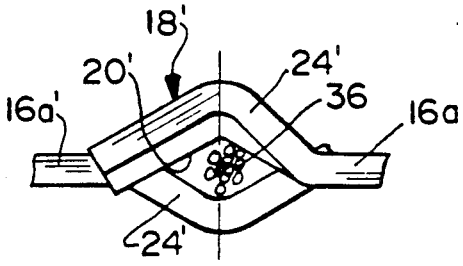
FIG. 11 is a fragmented top plan view of the terminal in the position of FIG. 10.

Referring to FIGS. 10–13, and first to FIG. 10, a housing, generally designated 34' is provided for assembly about terminal 10' and for effecting opening and closing of the terminal arms to receive and trap conductor 36 of electrical wire 38, in response to movement of the housing to its assembled position relative to the terminal, as shown in FIG. 12. Again, housing 34 may be in the form of a header which is elongated in a direction perpendicular to the drawings to define an elongated cavity 40' within which a plurality of terminals 10' are housed in a row. The housing has side walls 44' and a top wall 46' defining cavity 40'. The top wall has a series of holes 48' each being provided for insertion therethrough of electrical wire 38 and conductor 36.

In the embodiment of the invention shown in FIGS. 8–13, in order to open jaw means 18' (or jaw means 118 in FIG. 8), housing 34' is positioned about terminal 10' in a pre-assembled position shown in FIG. 10. In this position, can means in the form of inwardly tapered portions of side walls 44' are in engagement with the outside of enlarged portions 16*a* ', as at 90, to bias spring arms 16' inwardly as shown in FIG. 10 away from the unbiased state of the spring arms as shown in FIG. 9. In this position, it can be seen in FIG. 11 that tabs 24' are in an open position defining diamond shape opening 20'. In this condition, conductor 36 (which is shown as a stranded conductor in FIG. 11) can be freely inserted downwardly into the opening of the jaw means defined by tabs 24'.

Figure 13:
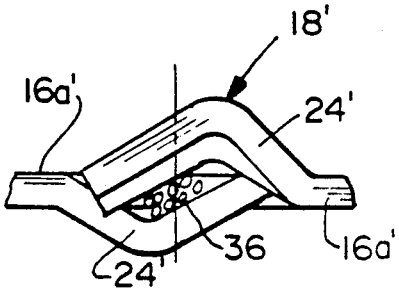
FIG. 13 is a fragmented top plan view of the terminal arms in the position of FIG. 12.

In order to terminate conductor 36, and referring to FIG. 12, housing 34' is pulled upwardly in the direction side walls 44' release spring arms 16' and whereby the spring arms are self-spring biased outwardly in the direction of arrows "F" to trap the conductor. The trapping condition of the spring arms, and particularly jaw means 18' defined by tabs 24', is shown in FIG. 13.

In order to retain housing 34' on terminal 10' and define the upper limit or trapping position of the housing relative to the terminal, the aforesaid retention arms 125 are provided. Specifically, the retention arms have outwardly hooked portions 125*a*, and side walls 44' of housing 34' have openings 126. The retention arms are located and configured such that hooked portions 125*a* abut against the bottom edge of openings 126 to define the upper limit position of housing 34' and the terminating position of terminal 10' on conductor 36.

In order to release conductor 36, housing 34 simply is depressed or pushed downwardly opposite the direction of arrow "E" (FIG. 12) back to the position shown in FIG. 10, and spring arms 16' will be forced toward each other to open jaw means 18' and release the conductor.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical conductor trap-type terminal, comprising a base and a pair of terminal arms projecting from the base, the terminal arms being spring biased toward each other when moved away from each other and including jaw means for trapping an electrical conductor therebetween, the jaw means being configured such that spreading of the terminal arms against their spring bias opens the jaw means to receive the conductor, the jaw means trapping the wire when the terminal arms are released;

said jaw means defining a diamond shaped conductor-receiving opening having an axis coincident with a conductor when positioned in the opening, said terminal arms being spring biased substantially in a plane transverse to said axis.

2. The terminal of claim 1 wherein said jaw means comprise tabs on each terminal arm projecting toward the other terminal arm out of said transverse plane and spaced from said axis.

3. The terminal of claim 2 wherein at least a pair of said table are disposed on each terminal arm, the tabs of each pair projecting to opposite sides of said axis, and the tabs on each terminal arm being offset vertically to the tabs of an opposite terminal arm along said axis.

4. The terminal of claim 1 in combination with a terminal housing, and including complementary interengaging means between the terminal arms and the housing for spreading the terminal arms in response to relative movement between the housing and the terminal arms.

5. An electrical conductor trap-type terminal comprising a pair of terminal arms spring biased toward each other when moved away from each other and including jaw means defining a conductor-receiving opening for trapping an electrical conductor therebetween, the opening having an axis coincident with the conductor when positioned in the opening, the terminal arms being spring biased substantially along a plane transverse to said axis, and the jaw means including tabs on each terminal arm projecting toward the other terminal arm out of said transverse plane and spaced from said axis;

at least a pair of said table are disposed on each terminal arm, the tabs of each pair projecting to opposite sides of said axis, and the table on each terminal arm being offset vertically to the tabs on an opposite terminal arm along said axis;

said jaw means are configured to form said opening in a diamond shape.

6. The terminal of claim 5 in combination with a terminal housing, and including complementary interengaging means between the terminal arms and the housing for spreading the terminal arms in response to relative movement between the housing and the terminal arms,

7. An electrical conductor trap-type terminal, comprising a pair of terminal arms including jaw means defining a diamond shaped conductor-receiving opening having an axis coincident with a conductor when positioned in the opening, the jaw means including at least a pair of tabs disposed on each terminal arm projecting at angles their respective terminal arms, to opposite sides of said axis, and the tabs on each terminal arm being offset vertically to the tabs of an opposite terminal arm along said axis.

8. An electrical conductor trap-type terminal, comprising a pair of generally flat, coplanar terminal arms including jaw means for trapping an electorial conductor therebetween, the maw means including at least a pair of tabs bent outwardly from the flat terminal arms to define a diamond-shaped opening for receiving an electrical conductor therein;

the tabs of each pair being bent to opposite sides of an axis of the opening, and the tabs on each terminal arm being offset vertically to the tabs at an opposite terminal arm along said axis.

9. An electrical conductor trap-type connector, comprising:

a housing into which the electrical conductor can be inserted;

a terminal disposed in the housing and having a pair of terminal arms spring biased toward each other when moved away from each other and including jaw means for trapping the electrical conductor therebetween; and complementary interengaging means between the housing and the terminal arms for spreading the terminal arms apart against their spring bias to open the jaw means and receive the conductor in response to relative movement between the housing and the terminal arms;

said complementary interengaging means comprise: cam means for spreading the terminal arms, and for allowing the terminal arms to move toward each other under their spring bias to trap the conductor in response to further relative movement between the housing and the terminal arms and said cam means include stop means to define the trapping position of the terminal arms; actuator arms on the inside of the housing for engaging and spreading the terminal arms;

said jaw means define a conductor-receiving opening having an axis coincident with a conductor when positioned in the opening, said terminal arms being spring biased transverse to said axis wherein said jaw means are configured to form said opening in a diamond shape and comprise tabs on each terminal arm projecting away from the terminal arm and toward the other terminal arm and spaced from said axis.

10. The connector of claim 9 wherein at least a pair of said tabs are disposed on each terminal arm, the tabs of each pair being offset to opposite sides of said axis, and the tabs on each terminal arm being offset vertically to the tabs of an opposite terminal arm along said axis.

11. An electrical conductor trap-type terminal, comprising a base and a pair of terminal arms projecting from the base and integral with the base, the terminal arms being spring loaded whereby, when the terminal arms are moved relative to each other to a conductor receiving position, the terminal arms will return automatically to a conductor trapping position, the terminal arms including jaw means configured such that relative movement of the terminal arms to said conductor receiving position opens the jaw means to receive the conductor, the jaw means trapping the conductor when the terminal arms are in said conductor trapping position and wherein said jaw means define a diamond shaped conductor-receiving opening having an axis coincident with a conductor when positioned in the opening, said terminal arms being spring biased transverse to said axis.

12. The terminal of claim 11 wherein said jaw means comprise at least one tab on each terminal arm projecting toward the other terminal arm and spaced a predetermined distance away from said axis.

13. The terminal of claim 12 wherein the taps on the respective arms are offset vertically along said axis.

* * * * *